US009624731B2

(12) United States Patent
Haugvaldstad et al.

(10) Patent No.: US 9,624,731 B2
(45) Date of Patent: Apr. 18, 2017

(54) ROLLING CUTTER WITH SIDE RETENTION

(71) Applicant: Smith International, Inc., Houston, TX (US)

(72) Inventors: Kjell Haugvaldstad, Trondheim (NO); Youhe Zhang, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 338 days.

(21) Appl. No.: 14/358,490

(22) PCT Filed: Nov. 16, 2012

(86) PCT No.: PCT/US2012/065473

§ 371 (c)(1),
(2) Date: May 15, 2014

(87) PCT Pub. No.: WO2013/074898

PCT Pub. Date: May 23, 2013

(65) Prior Publication Data

US 2014/0326516 A1 Nov. 6, 2014

Related U.S. Application Data

(60) Provisional application No. 61/561,016, filed on Nov. 17, 2011.

(51) Int. Cl.
*E21B 10/43* (2006.01)
*E21B 10/567* (2006.01)
(Continued)

(52) U.S. Cl.
CPC ..... *E21B 10/43* (2013.01); *E21B 10/567* (2013.01); *E21B 10/573* (2013.01); *E21B 10/633* (2013.01)

(58) Field of Classification Search
CPC ..... E21B 10/573; E21B 10/633
See application file for complete search history.

(56) References Cited

U.S. PATENT DOCUMENTS 4,104,344 A 8/1978 Pope et al.
4,222,446 A 9/1980 Vasek
(Continued)

OTHER PUBLICATIONS

International Search Report and Written Opinion of PCT Application Serial No. PCT/US2012/065473 dated Feb. 28, 2013 (10 pages).

*Primary Examiner* — Shane Bomar

(57) ABSTRACT

A cutter assembly may include a sleeve having at least one passageway extending through the sleeve from a outer surface thereof into an inner surface thereof; at least one rotatable cutting element disposed in the sleeve, wherein the at least one rotatable cutting element has a circumferential groove formed in a side surface thereof, wherein when the inner rotatable cutting element is disposed in the sleeve, the circumferential groove is aligned with the passageway; and a retention element disposed in at least a portion of the passageway and the circumferential groove to retain the at least one rotatable cutting element in the sleeve, wherein the retention element has an axis that is parallel to a tangent of the rotatable cutting element side surface at least one point of contact with the rotatable cutting element.

20 Claims, 6 Drawing Sheets

(51) Int. Cl.
*E21B 10/573* (2006.01)
*E21B 10/633* (2006.01)

(56) References Cited

U.S. PATENT DOCUMENTS

| | | | | |
|---|---|---|---|---|
| 4,288,248 | A | 9/1981 | Bovenkerk et al. | |
| 4,553,615 | A | 11/1985 | Grainger | |
| 5,127,923 | A | 7/1992 | Bunting et al. | |
| 5,497,843 | A * | 3/1996 | Burns | E21C 35/183 175/403 |
| 5,678,645 | A * | 10/1997 | Tibbitts | E21B 10/5673 175/426 |
| 7,070,011 | B2 | 7/2006 | Sherwood, Jr. et al. | |
| 7,703,559 | B2 | 4/2010 | Shen et al. | |
| 8,727,043 | B2 * | 5/2014 | Zhang | E21B 10/573 175/413 |
| 2005/0087371 | A1 | 4/2005 | Kembaiyan | |
| 2007/0278017 | A1 | 12/2007 | Shen et al. | |
| 2009/0020339 | A1 | 1/2009 | Sherwood, Jr. et al. | |
| 2010/0108403 | A1 | 5/2010 | Keshavan | |
| 2010/0314176 | A1 | 12/2010 | Zhang et al. | |
| 2012/0273280 | A1 | 11/2012 | Zhang et al. | |
| 2013/0014637 | A1 | 1/2013 | Cannon | |
| 2015/0322727 | A1 * | 11/2015 | Do | E21B 10/633 175/413 |
| 2016/0153243 | A1 * | 6/2016 | Hinz | E21B 10/43 175/57 |

* cited by examiner

ROLLING CUTTER WITH SIDE RETENTION

BACKGROUND

Technical Field

Embodiments disclosed herein relate generally to polycrystalline diamond compact cutters and bits or other cutting tools incorporating the same. More particularly, embodiments disclosed herein relate to rolling cutters having retained within a cutter pocket or sleeve along a side surface of the cutter and bits or other cutting tools incorporating the same.

Background Art

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical application, a compact of polycrystalline diamond (PCD) (or other ultrahard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter is conventionally formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

An example of a prior art PDC bit having a plurality of cutters with ultra hard working surfaces is shown in FIGS. 1A and 1B. The drill bit 200 includes a bit body 210 having a threaded upper pin end 211 and a cutting end 215. The cutting end 214 typically includes a plurality of ribs or blades 220 arranged about the rotational axis L (also referred to as the longitudinal or central axis) of the drill bit and extending radially outward from the bit body 210. Cutting elements, or cutters, 250 are embedded in the blades 220 at predetermined angular orientations and radial locations relative to a working surface and with a desired back rake angle and side rake angle against a formation to be drilled.

A plurality of orifices 216 are positioned on the bit body 210 in the areas between the blades 220, which may be referred to as "gaps" or "fluid courses." The orifices 216 are commonly adapted to accept nozzles. The orifices 216 allow drilling fluid to be discharged through the bit in selected directions and at selected rates of flow between the blades 220 for lubricating and cooling the drill bit 200, the blades 220 and the cutters 250. The drilling fluid also cleans and removes the cuttings as the drill bit 200 rotates and penetrates the geological formation. Without proper flow characteristics, insufficient cooling of the cutters 250 may result in cutter failure during drilling operations. The fluid courses are positioned to provide additional flow channels for drilling fluid and to provide a passage for formation cuttings to travel past the drill bit 200 toward the surface of a wellbore (not shown).

Referring to FIG. 1B, a top view of a prior art PDC bit is shown. The cutting face 218 of the bit shown includes six blades 220-225. Each blade includes a plurality of cutting elements or cutters generally disposed radially from the center of cutting face 218 to generally form rows. Certain cutters, although at differing axial positions, may occupy radial positions that are in similar radial position to other cutters on other blades.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutter assembly that includes a sleeve having at least one passageway extending through the sleeve from a outer surface thereof into an inner surface thereof; at least one rotatable cutting element disposed in the sleeve, wherein the at least one rotatable cutting element has a circumferential groove formed in a side surface thereof, wherein when the inner rotatable cutting element is disposed in the sleeve, the circumferential groove is aligned with the passageway; and a retention element disposed in at least a portion of the passageway and the circumferential groove to retain the at least one rotatable cutting element in the sleeve, wherein the retention element has an axis that is parallel to a tangent of the rotatable cutting element side surface at at least one point of contact with the rotatable cutting element.

In another aspect, embodiments disclosed herein relate to a downhole cutting tool that includes a cutting element support structure having at least one cutter pocket formed therein; wherein the cutting element support structure has at least one passageway extending from a top, outer surface of the cutting element support structure into the cutter pocket; at least one rotatable cutting element disposed in the at least one cutter pocket, wherein the at least one rotatable cutting element has a circumferential groove formed in a side surface thereof, wherein when the inner rotatable cutting element is disposed in the cutter pocket, the circumferential groove is aligned with the passageway; and a retention element disposed in at least a portion of the passageway and the circumferential groove to retain the at least one rotatable cutting element on the downhole cutting tool, wherein the retention element has an axis that is parallel to a tangent of the rotatable cutting element side surface at at least one point of contact with the rotatable cutting element.

In yet another aspect, embodiments disclosed herein relate to a downhole cutting tool that includes a cutting element support structure having at least one cutter pocket formed therein; and a cutter assembly having a sleeve having at least one passageway extending through the sleeve from a outer surface thereof into an inner surface thereof; at least one rotatable cutting element disposed in the sleeve, wherein the at least one rotatable cutting element has a circumferential groove formed in a side surface thereof, wherein when the inner rotatable cutting element is disposed in the sleeve, the circumferential groove is aligned with the passageway; and a retention element disposed in at least a portion of the passageway and the circumferential groove to retain the at least one rotatable cutting element in the sleeve, wherein the retention element has an axis that is parallel to a tangent of the rotatable cutting element side surface at at least one point of contact with the rotatable cutting element.

Other aspects and advantages of the claimed subject matter will be apparent from the following description and the appended claims.

DETAILED DESCRIPTION

In one aspect, embodiments disclosed herein relate to polycrystalline diamond compact cutters being retained on a drill bit or other cutting by a mechanism that interfaces the cutter along a side surface thereof such that the cutter is free to rotate about its longitudinal axis. Embodiments of the present disclosure relate to a cutting element that is retained within a sleeve structure, which is fixedly attached to a drill bit or other cutting tool, and also to a cutting element that is retained directed within a cutter pocket. Illustrations of each of these embodiments are shown.

Figure 1A:
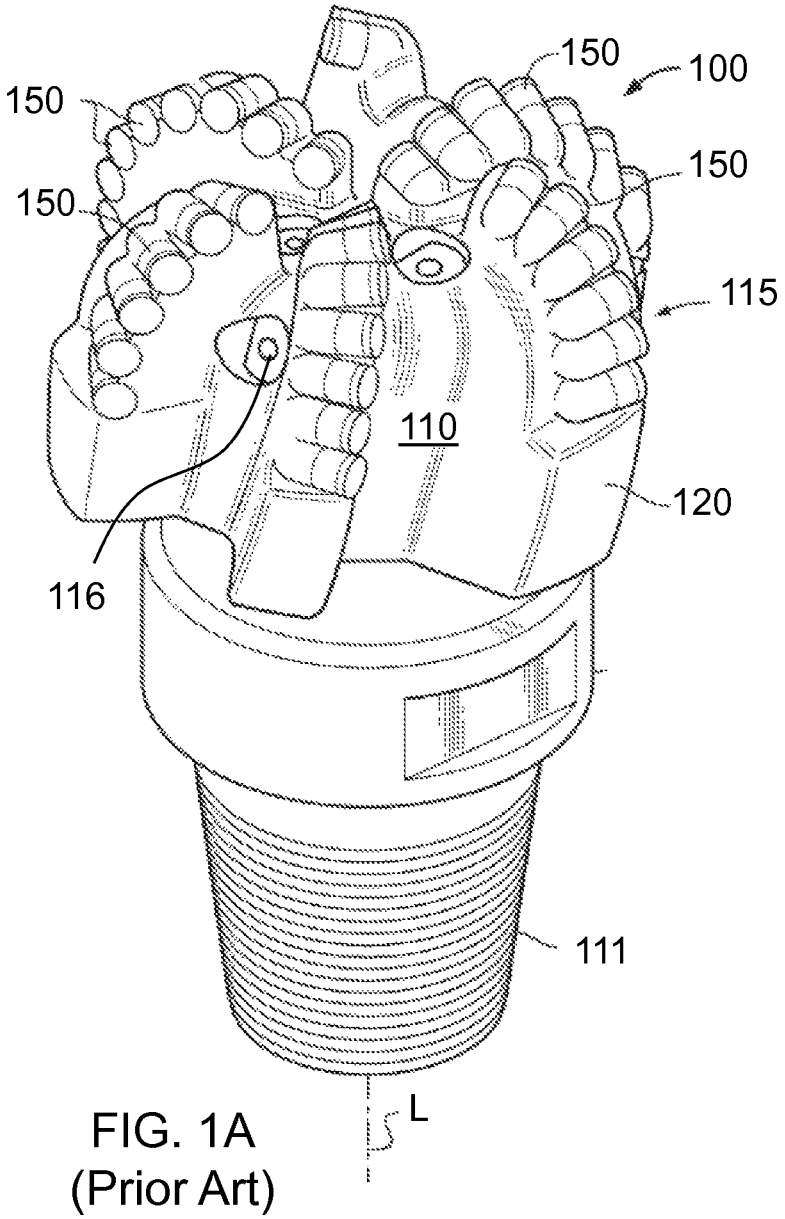
FIG. 1A (Prior Art)
FIGS. 1A and 1B show a side and top view of a conventional drag bit.
Figure 1B:
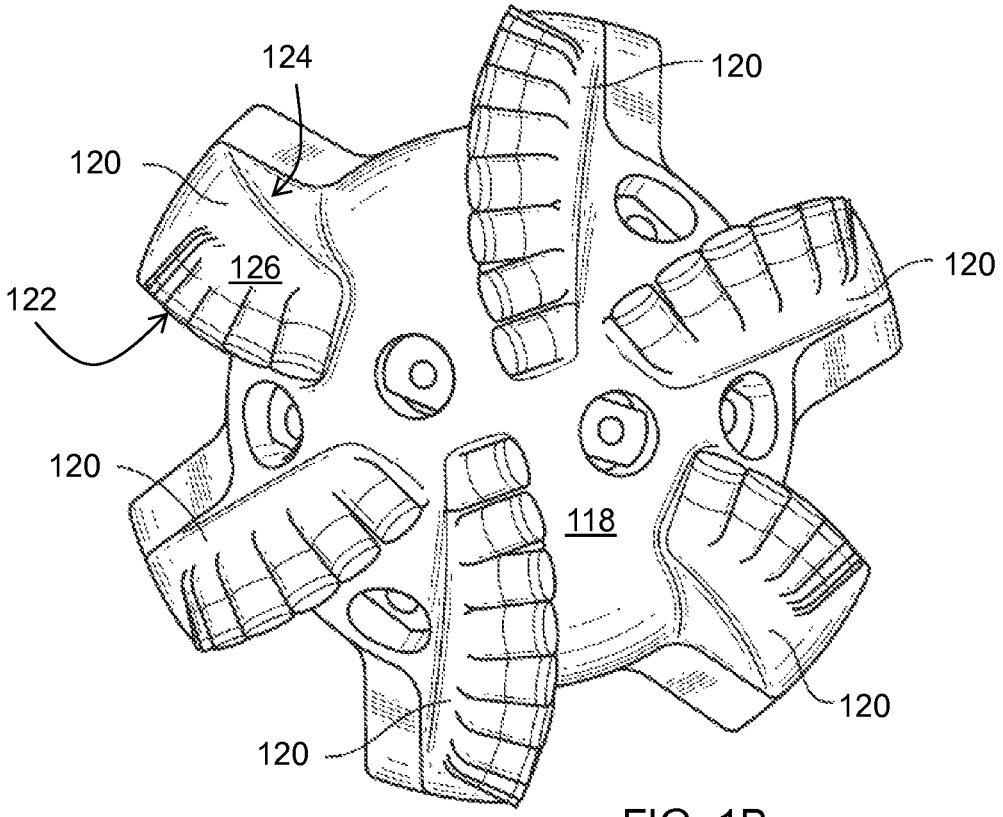
FIG. 1B (Prior Art)
Figure 2:
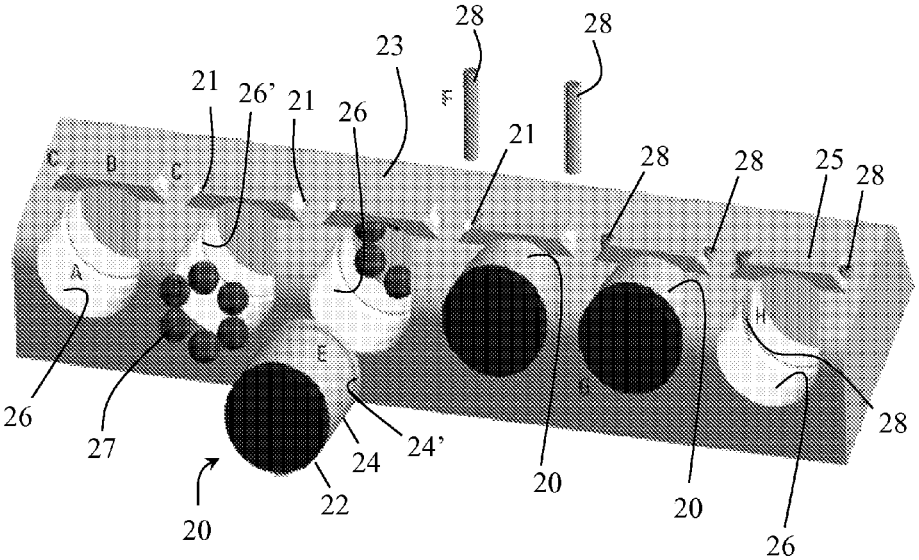
FIG. 2 shows one embodiment of a cutting element.

FIG. 2 illustrates different disassembled and assembled views of a rotatable cutting element on a cutting element support structure (which may be a blade, for example, on a fixed cutter drill bit). As shown in FIG. 2, a rotatable cutting element 20 possesses an ultrahard material layer 22 and a substrate 24. Rotatable cutting element 20 is disposed in a cutter pocket 26 and is retained in place by rods 28. Rods 28 are inserted through passageways 21 extending from an outer surface of the outer support element (a cutting element support structure, for example) 23 through to the cutter pocket 26. As illustrated, the passageways terminate in a groove 26' formed in the cutter pocket 26. When rotatable cutting element 20 is disposed in cutter pocket 26, a circumferential groove 24' formed in side surface of the cutting element 20 is aligned with the passageway 21 and/or groove 26' in the cutter pocket 26 so that rods 28, when inserted into passageways 21, fit in at least a portion of the circumferential groove 24' (and groove 26' when included) such that an axis of the rods 28 parallel to a tangent of a side surface of rotatable cutting element 20 at at least one point of contact with the rotatable cutting element 20. Rods 28 may be fixed in place by welding (such as friction stir welding or tack welding), adhesives (such as cyanoacrylates or epoxies) or the like. As shown, a protrusion 25 may optionally extend from an outer surface of the cutting element support structure 23 to protect and increase the ease and fixability of the rods to the cutting element support structure.

Figure 3:
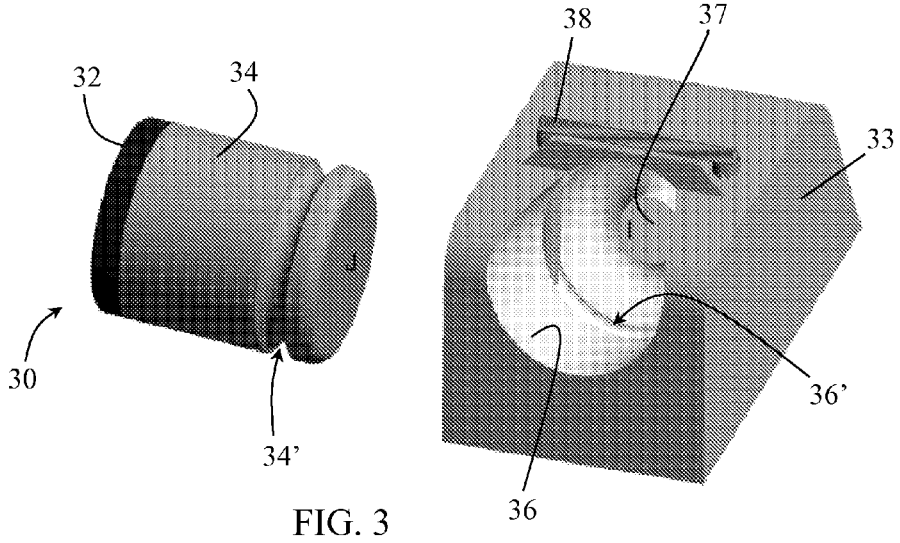
FIG. 3 shows one embodiment of a cutting element.

FIG. 3 illustrates another embodiment of a disassembled rotatable cutting element on a cutting element support structure (which may be a blade, for example, on a fixed cutter drill bit). As shown in FIG. 3, a rotatable cutting element 30 possesses an ultrahard material layer 32 and a substrate 34. Rotatable cutting element 30 is disposed in a cutter pocket 36 and is retained in place by retainer clip 38. The rod ends of retainer clip 38 are inserted through passageways 31 extending from an outer surface of the outer support element (a cutting element support structure, for example) 33 through to the cutter pocket 36. As illustrated, the passageways terminate in a groove 36' formed in the cutter pocket 36. When rotatable cutting element 30 is disposed in cutter pocket 36, a circumferential groove 34' formed in side surface of the cutting element 30 is aligned with the passageway 31 and/or groove 36' in the cutter pocket 36 so that rods 38, when inserted into passageways 31, fit in at least a portion of the circumferential groove 34' (and groove 36' when included) such that an axis of the rod ends of retainer clip 38 is parallel to a tangent of a side surface of rotatable cutting element 30 at at least one point of contact with the rotatable cutting element 30. Retainer clip 38 may be fixed in place by welding (such as friction stir welding or tack welding), adhesives (such as cyanoacrylates or epoxies) or the like. Optionally, the outer surface of cutting element support structure may have a recess (not shown) formed therein in which the upper portion of retainer clip 38 is embedded to provide additional protection from the drilling conditions.

Figure 4:
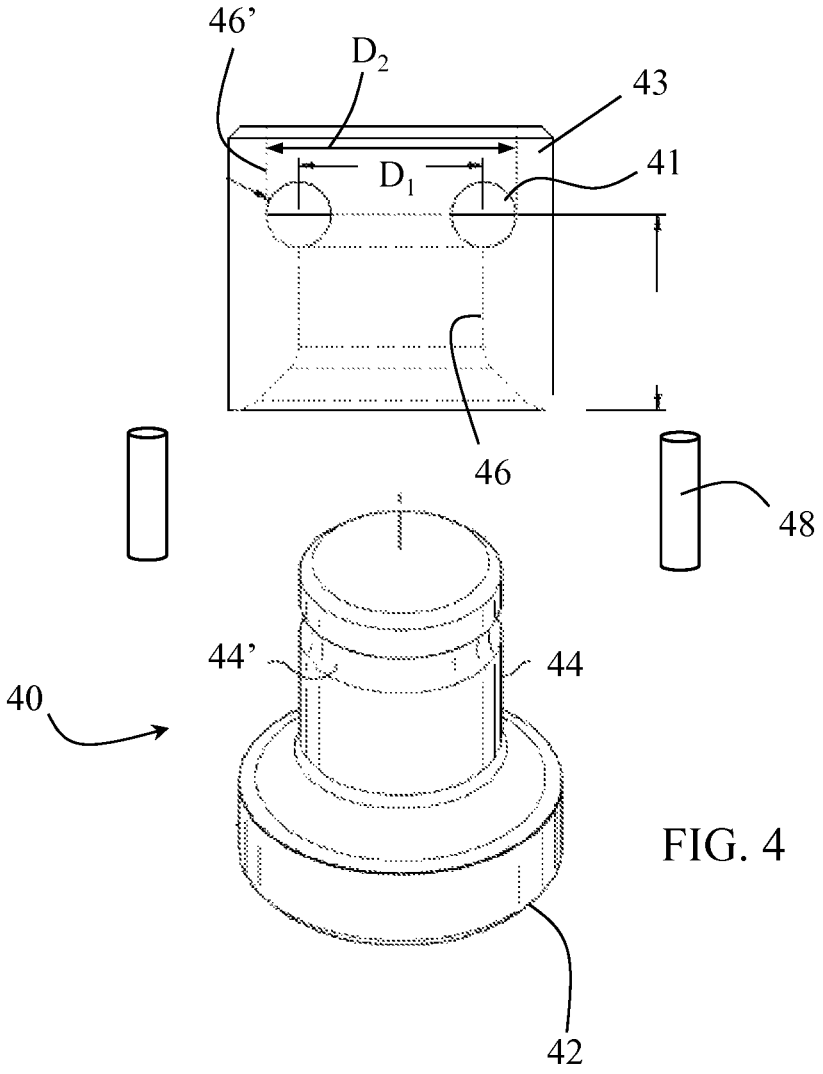
FIG. 4 shows one embodiment of a cutting element.

FIG. 4 illustrates a disassembled view of a rotatable cutting element with a sleeve. As shown in FIG. 4, a rotatable cutting element 40 possesses an ultrahard material layer 42 and a substrate 44. Rotatable cutting element 40 is disposed in a cavity 46 in a sleeve 43 and is retained in place by rods 48. Rods 48 are inserted through passageways 41 extending from an outer surface of sleeve 42 (the outer support element through to the cavity 46. As illustrated, the passageways 41 terminate in a groove 46' formed in the cavity 46. When rotatable cutting element 40 is disposed in sleeve 43, a circumferential groove 44' formed in side surface of the cutting element 40 is aligned with the passageway 41 and/or groove 46' in the inner surface of sleeve 43 so that rods 48, when inserted into passageways 41, fit in at least a portion of the circumferential groove 44' (and groove 46' when included) such that an axis of the rods 48 parallel to a tangent of a side surface of rotatable cutting element 40 at at least one point of contact with the rotatable cutting element 40. Rods 48 may be fixed in place by welding (such as friction stir welding or tack welding), adhesives (such as cyanoacrylates or epoxies) or the like. As illustrated groove 46' formed in the sleeve 43 is at a greater diameter D2 than the diameter D1 immediately forward (closer to the cutting surface) of the groove 46'.

Figure 5:
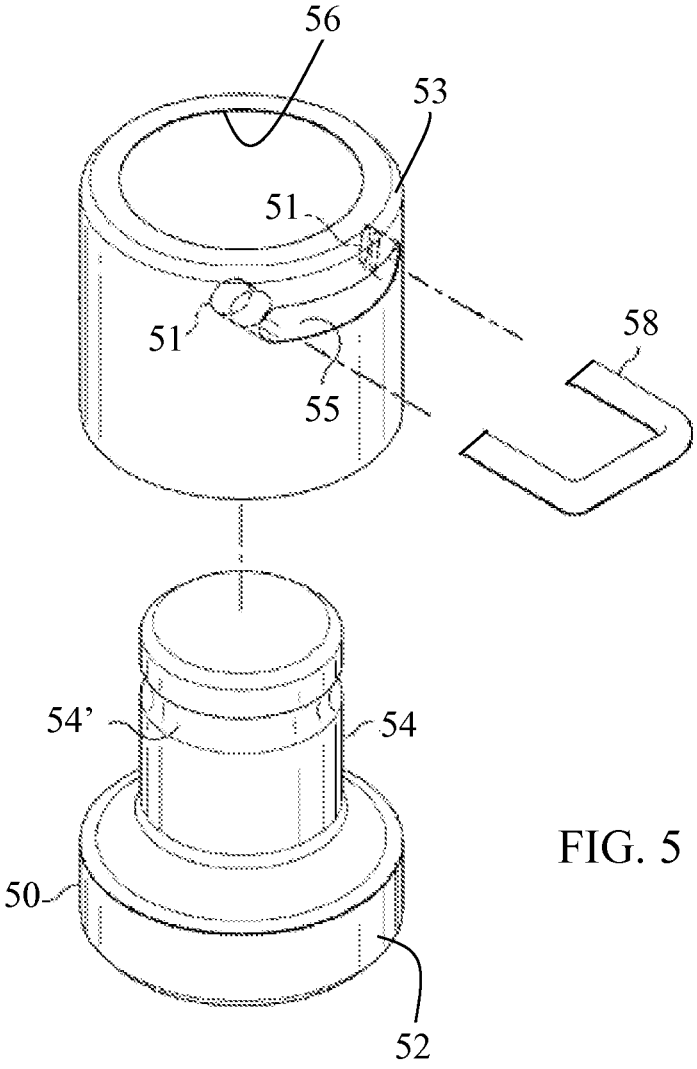
FIG. 5 shows one embodiment of a cutting element.

FIG. 5 illustrates a disassembled view of a rotatable cutting element with a sleeve. As shown in FIG. 5, a rotatable cutting element 50 possesses an ultrahard material layer 52 and a substrate 54. Rotatable cutting element 50 is disposed in a cavity 56 in a sleeve 53 and is retained in place by retainer clip 58. Rod ends of retainer clip 58 are inserted through passageways 51 extending from an outer surface of sleeve 52 (the outer support element) through to the cavity 56. When rotatable cutting element 50 is disposed in sleeve 53, a circumferential groove 54' formed in side surface of the cutting element 50 is aligned with the passageway 51 and/or optionally groove (not shown) in the inner surface of sleeve 53 so that rod ends of retainer clip 58, when inserted into passageways 51, fit in at least a portion of the circumferential groove 54' (and groove (not shown) in sleeve 53, when included) such that an axis of the rods 58 parallel to a tangent of a side surface of rotatable cutting element 50 at at least one point of contact with the rotatable cutting element 50. Retainer clip 58 may be fixed in place by welding (such as friction stir welding or tack welding), adhesives (such as cyanoacrylates or epoxies) or the like. Further, as illustrated in FIG. 5, the sleeve 53 may have a recess 55 so the upper portion of retainer clip 58 is recessed to provide additional protection from the drilling conditions.

The rods and retention clips used in all of the above described embodiments may be formed from any wear resistant material, such as, for example, metal carbides, nitrides, or borides, tool steel, or the like. Size of each may be determined by the size of the cutters, bits, etc.

Further, one or more of the above embodiments may be provided with a plurality of balls (27, as illustrated in FIG. 2) or a reduced contact surface area (37, as illustrated in FIG. 3) to improve rolling efficiency. Such features may be included in a cutter assembly or cutting structure on a bit or other cutting tool as described in U.S. patent application Ser. Nos. 61/479,183 and 61/559,423, both of which are assigned to the present assignee and herein incorporated by reference in their entirety.

Figure 6:
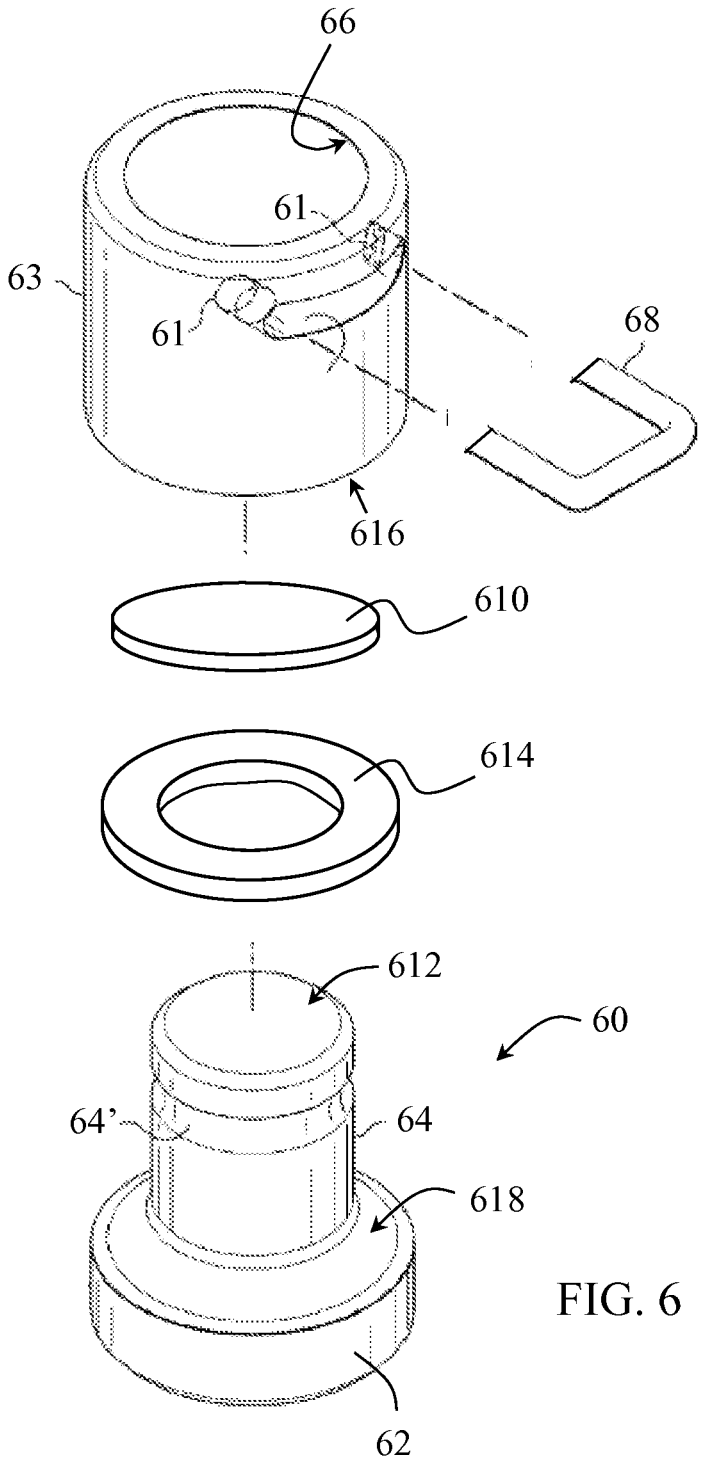
FIG. 6 shows one embodiment of a cutting element.

Any of the above described embodiments may also include the use of diamond between interfacing surfaces of the inner rotatable element and the outer support element (either sleeve or cutting element support structure) in which it is retained. For example, diamond (or a similar material) may be incorporated on either the inner rotatable cutting element or the outer support element on any radial or axial bearing surface, or a separate diamond component may be used placed between the two components. For example, the bottom face of an inner rotatable cutting element or the shoulder of a sleeve may be formed of diamond or a similar material. Use of diamond on various bearing surfaces (integral with the cutting element components) is described in U.S. Pat. No. 7,703,559, which is assigned to the present assignee and herein incorporated by reference in its entirety. Alternatively (and/or additionally), a separate diamond disc or washer may be placed adjacent a bottom face of the inner rotatable cutting element or adjacent the shoulder of a sleeve on which an inner rotatable cutting element rests. For example, an illustration of such embodiment may be shown in FIG. 6. FIG. 6 illustrates a disassembled view of a rotatable cutting element with a sleeve. As shown in FIG. 6, a rotatable cutting element 60 possesses an ultrahard material layer 62 and a substrate 64. Rotatable cutting element 60 is disposed in a cavity 66 in a sleeve 63 and is retained in place by retainer clip 68. Rod ends of retainer clip 68 are inserted through passageways 61 extending from an outer surface of sleeve 62 (the outer support element) through to the cavity 66. When rotatable cutting element 60 is disposed in sleeve 63, a circumferential groove 64' formed in side surface of the cutting element 60 is aligned with the passageway 61 and/or optionally groove (not shown) in the inner surface of sleeve 63 so that rod ends of retainer clip 68, when inserted into passageways 61, fit in at least a portion of the circumferential groove 64' (and groove (not shown) in sleeve 63, when included) such that an axis of the rods 68 parallel to a tangent of a side surface of rotatable cutting element 60 at at least one point of contact with the rotatable cutting element 60. Retainer clip 68 may be fixed in place by welding (such as friction stir welding or tack welding), adhesives (such as cyanoacrylates or epoxies) or the like. A diamond or other ultrahard material disc 610 may be present adjacent the bottom face 612 of the inner rotatable cutting element 60 and/or a diamond or other ultrahard material washer 614 may be present at an interface between an upper sleeve surface 616 and the transition surface 618 between the full cutter diameter and the reduced diameter portion disposed in sleeve 63. Diamond or another ultrahard material may also (and/or alternatively) form any of surfaces 612, 616, and 618 and/or a bottom face of sleeve (not shown). Use of ultrahard materials in any of such manners (alone or in any combination) may be applied to any of the embodiments described herein.

According to some embodiments, a disc 610 and/or a washer 614 may include materials other than or in addition to diamond or other ultrahard materials. For example, a disc and/or a washer may have a layer of brass or other material softer than carbide, such as a steel alloy. The layer of softer material may range from between 0.01 inches to less than 0.002 inches, for example. In other embodiments, a disc and/or a washer may be formed entirely of a material softer than diamond. For example, a disc may be formed entirely of carbide. In some embodiments, a carbide disc may act as a sacrificial piece, which may wear preferentially to the sleeve, such that upon wear, the sleeve may not need to be replaced. Other combinations of diamond or other ultrahard materials and softer materials may be used to form the disc and/or washer. For example, diamond surfaces may be used to reduce friction and softer materials such as steel alloys may be used to absorb impact load.

In embodiment using a sleeve, such sleeve may be fixed to the bit body (or other cutting tool) by any means known in the art, including by casting in place during sintering the bit body (or other cutting tool) or by brazing the element in place in the cutter pocket (not shown). Brazing may occur before or after the inner rotatable cutting element is retained within the sleeve; however, in particular embodiments, the inner rotatable cutting element is retained in the sleeve after the sleeve is brazed into place.

Each of the embodiments described herein have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The outer support element may be formed from a variety of materials. In one embodiment, the outer support element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent. It is also within the scope of the present disclosure that the outer support element (including a back retention mechanism) may also include more lubricious materials to reduce the coefficient of friction. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

In other embodiments, the sleeve may be formed of alloy steels, nickel-based alloys, and cobalt-based alloys. One of ordinary skill in the art would also recognize that cutting element components may be coated with a hardfacing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or as inserts in roller cone bits. Bits having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A cutter assembly, comprising:

a sleeve having at least one passageway extending through the sleeve from a outer surface thereof into an inner surface thereof, the at least one passageway terminating in a groove formed in the inner surface of the sleeve;

at least one rotatable cutting element disposed in the sleeve, wherein the at least one rotatable cutting element has a circumferential groove formed in a side surface thereof, wherein when the at least one rotatable cutting element is disposed in the sleeve, the circumferential groove is aligned with the passageway and the groove in the inner surface of the sleeve; and a retention element disposed in at least a portion of the passageway, the groove in the inner surface of the sleeve, and the circumferential groove to retain the at least one rotatable cutting element in the sleeve, wherein the retention element has an axis that extends through the at least one passageway and from the outer surface toward the at least one rotatable cutting element and that is parallel to a tangent of the rotatable cutting element side surface at at least one-point of contact between the retention element and the rotatable cutting element.

2. The cutter assembly of claim 1, wherein the sleeve comprises two of such passageways each terminating in the sleeve groove, and wherein two retention elements are disposed in portions of the circumferential groove and sleeve grooves to retain the at least one rotatable cutting element within the sleeve.

3. The cutter assembly of claim 2, wherein the two passageways are parallel.

4. The cutter assembly of claim 1, wherein the retention element comprises a rod.

5. The cutter assembly of claim 1, wherein the sleeve comprises two of such passageways, wherein the retention element comprises a retaining clip having each end inserted into the two passageways and disposed in portions of the circumferential groove to retain the at least one rotatable cutting element within the sleeve.

6. The cutter assembly of claim 1, further comprising a plurality of balls disposed between a bottom face of the at least one rotatable cutting element and a bottom portion of the sleeve.

7. The cutter assembly of claim 1, wherein a bottom portion of the sleeve interfaces a bottom face of the at least one rotatable cutting element at less than the entire surface area of the bottom face of the at least one rotatable cutting element.

8. The cutter assembly of claim 1, wherein the at least one rotatable cutting element comprises an ultrahard material on its bottom face.

9. The cutter assembly of claim 1, wherein at least one interfacing surface between the at least one rotatable cutting element and the sleeve comprises diamond.

10. The cutter assembly of claim 1, the retention element including an elongated rod in the at least a portion of the passageway, the axis extending axially through the elongated rod.

11. A downhole cutting tool, comprising:

a cutting element support structure having at least one cutter pocket formed therein; wherein the cutting element support structure has at least one passageway extending from a top, outer surface of the cutting element support structure into the cutter pocket, the at least one passageway terminating in a groove formed in an inner surface of the cutter pocket;

at least one rotatable cutting element disposed in the at least one cutter pocket, wherein the at least one rotatable cutting element has a circumferential groove formed in a side surface thereof, wherein when the at least one rotatable cutting element is disposed in the cutter pocket, the circumferential groove is aligned with the passageway and the groove in the inner surface of the cutter pocket; and a retention element disposed in at least a portion of the passageway, the groove in the inner surface of the cutter pocket, and the circumferential groove to retain the at least one rotatable cutting element on the downhole cutting tool, wherein the retention element includes at least one rod having an axis that is parallel to a tangent of the rotatable cutting element side surface at at least one point of contact between the at least one rod and the rotatable cutting element.

12. The downhole cutting tool of claim 11, wherein the cutting element support structure comprises two of such passageways terminating in a pocket groove, and wherein two retention elements are disposed in portions of the circumferential groove and pocket grooves to retain the at least one rotatable cutting element within the cutter pocket.

13. The downhole cutting tool of claim 11, wherein the cutting element support structure comprises two of such passageways each terminating in a pocket groove, wherein the retention element comprises a retaining clip having each end inserted into the two passageways and disposed in portions of the circumferential groove and pocket grooves to retain the at least one rotatable cutting element within the cutter pocket.

14. The downhole cutting tool of claim 11, further comprising a plurality of balls disposed between a bottom face of the at least one rotatable cutting element and a back wall of the cutter pocket.

15. The downhole cutting tool of claim 11, wherein a back wall of the cutter pocket interfaces a bottom face of the at least one rotatable cutting element at less than the entire surface area of the bottom face of the at least one rotatable cutting element.

16. The downhole cutting tool of claim 11, wherein the at least one rotatable cutting element comprises an ultrahard material on its bottom face.

17. The downhole cutting tool of claim 11, wherein at least one interfacing surface between the at least one rotatable cutting element and the cutting element support structure comprises an ultrahard material.

18. The downhole cutting tool of claim 11, the axis extending axially through the passageway.

19. A downhole cutting tool, comprising:

a cutting element support structure having at least one cutter pocket formed therein; and a cutter assembly of disposed in the at least one cutter pocket, the cutter assembly including:

a sleeve having at least two passageways extending through the sleeve from a outer surface thereof into an inner surface thereof;

at least one rotatable element disposed in the sleeve, wherein the at least one rotatable element has a circumferential groove formed in a side surface thereof, wherein when the at least one rotatable element is disposed in the sleeve, the circumferential groove is aligned with the at least two passageways; and at least one retention element disposed in at least a portion of each of the at least two passageways and in the circumferential groove to retain the at least one rotatable element in the sleeve, wherein the at least one retention element has axes that extend through each of the at least two passageway and from the outer surface toward the at least one rotatable element, the axes each being parallel to a tangent of the rotatable element side surface at a point where the at least one retention element contacts the rotatable element.

20. The downhole cutting tool of claim 19, the cutter assembly being positioned along a leading edge of the cutting element support structure.

* * * * *